US005356241A

United States Patent [19]

Kunito

[11] Patent Number: 5,356,241

[45] Date of Patent: Oct. 18, 1994

[54] FOUNDATION HAVING CYLINDRICAL SHELL AND CONSTRUCTION METHOD THEREFOR

[75] Inventor: Mitsuhiro Kunito, Osaka, Japan

[73] Assignee: Seiko Kogyo Kabushiki Kaisha, Osaka, Japan

[21] Appl. No.: 958,167

[22] Filed: Oct. 8, 1992

[30] Foreign Application Priority Data

Oct. 8, 1991 [JP] Japan ..... 3-287337

[51] Int. Cl.[5] ..... E02D 3/00

[52] U.S. Cl. ..... 405/233; 405/229; 405/266

[58] Field of Search ..... 405/267, 233, 232, 229, 405/231, 222, 223, 269, 266

[56] References Cited

U.S. PATENT DOCUMENTS

| | | | |
|---|---|---|---|
| 3,618,327 | 11/1971 | Frein et al. . | |
| 3,939,664 | 2/1976 | Mazier et al. . | |
| 4,397,588 | 8/1983 | Goughnour | 405/233 X |
| 4,643,617 | 2/1987 | Kanno et al. | 405/222 |
| 4,692,065 | 9/1987 | Suzuki et al. | 405/229 X |
| 4,886,400 | 12/1989 | Taki et al. | 405/267 |
| 4,902,171 | 2/1990 | Geffriaud et al. | 405/232 |
| 4,906,142 | 3/1990 | Taki et al. . | |
| 5,112,161 | 5/1992 | Trevisani | 405/267 |
| 5,129,762 | 7/1992 | Legendre | 405/232 |

FOREIGN PATENT DOCUMENTS

| | | |
|---|---|---|
| 1434589 | 11/1971 | Fed. Rep. of Germany . |
| 3716750 | 12/1988 | Fed. Rep. of Germany . |
| 2283996 | 4/1976 | France . |
| 2186009 | 7/1990 | Japan . |

*Primary Examiner*—Dennis L. Taylor
*Attorney, Agent, or Firm*—Sughrue, Mion, Zinn, Macpeak & Seas

[57] ABSTRACT

A foundation comprising (1) a cylindrical shell made of a cast-in-place concrete placed into a ring-like groove which is formed by excavation of the soil at the place of installation of the foundation, leaving a columnar soil located radially inward with respect to the ring-like groove without discharging the soil, and (2) an internal solidified soil formed by solidifying the columnar soil surrounded by the cylindrical shell with a chemical hardener, and a construction method therefor.

15 Claims, 4 Drawing Sheets

FOUNDATION HAVING CYLINDRICAL SHELL AND CONSTRUCTION METHOD THEREFOR

BACKGROUND OF THE INVENTION

1. Field of the Invention

This invention relates to a foundation having a cylindrical shell for supporting a superstructure on the foundation, and a construction method therefor. In particular, the invention relates to a foundation having a cylindrical shell, which will be suitable for supporting structures, towers, tanks, silos, piers of bridges, etc., and a construction method therefor wherein the foundation is constructed leaving the soil inside the cylindrical shell, i.e., without discharging the soil.

2. Description of the Background Art

Well foundations or open caisson foundations are well known as cylindrical foundations, and such foundations are disclosed in U.S. Pat. Nos. 3,618,327 and 3,939,664. Such foundations are constituted by vertically placing a cylindrical structure, the upper and lower ends of which are open, in the place of installation, causing the cylindrical structure to settle into the ground while excavating the soil at the portion surrounded by the cylindrical structure, and finally placing a bottom slab of concrete. However, the size of the foundation itself has become greater recently with the increase in the scale of a superstructure placed on the foundation, and the diameter of a well of the well foundation also has become greater. Also, the excavation quantity of the internal soil has become greater during the excavation, and the volume of jobs for the excavation and discharge of the soil and the cost of the work accompanied thereby has increased remarkably.

The recent progress in the excavation technology has made it possible to excavate easily a deep groove in the ground, and the technology of an in-situ concrete diaphragm wall has made it possible to form a cylindrical structure. Therefore, a cylindrical foundation capable of being executed without excavating and discharging the soil thereinside such as in the conventional well foundation has been developed, such as the cylindrical foundation disclosed in Japanese Patent Laid-Open No. 186009/1990.

In the cylindrical foundation of the type described above, however, the soil inside the cylindrical structure, which is to serve as the shell, is not excavated and discharged but is left as is described above. If a superstructure is built up on such a cylindrical foundation, as the remaining soil gradually undergoes consolidation settlement, the negative friction resulting from this consolidation settling exerts adverse influences of adding a load bearing to the cylindrical structure. Furthermore, a cavity is created at the upper part on the inside of the cylindrical structure, so that flowing water remains inside the foundation and invites the breakage of the concrete due to freezing and the corrosion of reinforcing bars disposed at this part of the cylindrical structure.

Technology to mix and stir a hardener, such as a cement milk, with the soil to form a solidified soil layer and thereby constituting an underground structure without excavating and discharging the soil in situ is known as disclosed in U.S. Pat. Nos. 4,886,400 and 4,906,142. The underground structure consisting of this solidified soil provides an advantage over ordinary concrete structures in that it can be constituted without excavating and discharging the soil in situ, but yet involves problems such as a reduced reliability of strength and an increased possibility of degradation resulting from external environmental factors. Therefore, such an underground structure has mainly been used as a temporary retaining wall or a cut-off wall rather than as the foundation structure itself.

SUMMARY OF THE INVENTION

It is an object of the present invention to provide a foundation having a cylindrical shell and construction method therefor, which addresses the problems described above and eliminates any adverse influences resulting from consolidation settlement of neighboring soil.

It is another object of the present invention to provide a foundation having a cylindrical shell and construction method therefor, which allows a foundation structure to effectively bear the entire load of a superstructure.

It is still another object of the present invention to provide a foundation having a cylindrical shell and construction method therefor, which prevents degradation with time.

It is a further object of the present invention to provide a foundation having a cylindrical shell and construction method therefor, which reduces the volume of work, has a high execution safety and reduces the cost of the work.

These objects of the present invention can be accomplished by a foundation as described below having a cylindrical shell and construction method therefor, according to the present invention.

The foundation according to the present invention comprises a cylindrical shell made of a cast-in-place concrete which is placed into a ring-like groove excavated in the soil at the place of installation of the foundation while leaving the columnar soil there-inside, and an internal solidified soil formed by solidifying the columnar soil surrounded by the cylindrical shell by the use of a chemical hardener. The construction method of a foundation having a cylindrical shell according to the present invention comprises excavating a ring-like groove in the soil at the place of installation of the foundation while leaving the columnar soil located radially inward of the ring-like groove, placing a concrete in situ into the ring-like groove so as to form a cylindrical shell, and forming an internal solidified soil by mixing and stirring a chemical hardener with the columnar soil surrounded by the cylindrical shell. Alternatively, the construction method of a foundation of the present invention comprises mixing and stirring a chemical hardener with the underground soil in a range wider than a portion at which a cylindrical shell is to be disposed, so as to carry out solidification treatment of the soil of the region inclusive of the internal solidified soil formed inside the cylindrical shell, thereafter excavating a ring-like groove while leaving the internal solidified soil, and placing concrete into the ring-like groove so as to form the cylindrical shell described above.

BRIEF DESCRIPTION OF THE DRAWINGS

These and other objects and advantages of the present invention will become more apparent from the following description of embodiments thereof when taken in conjunction with the accompanying drawings, in which.

DESCRIPTION OF THE PREFERRED EMBODIMENTS

Hereinafter, a foundation having a cylindrical shell and its construction method according to the present invention will be explained with reference to the accompanying drawings.

Figure 1:
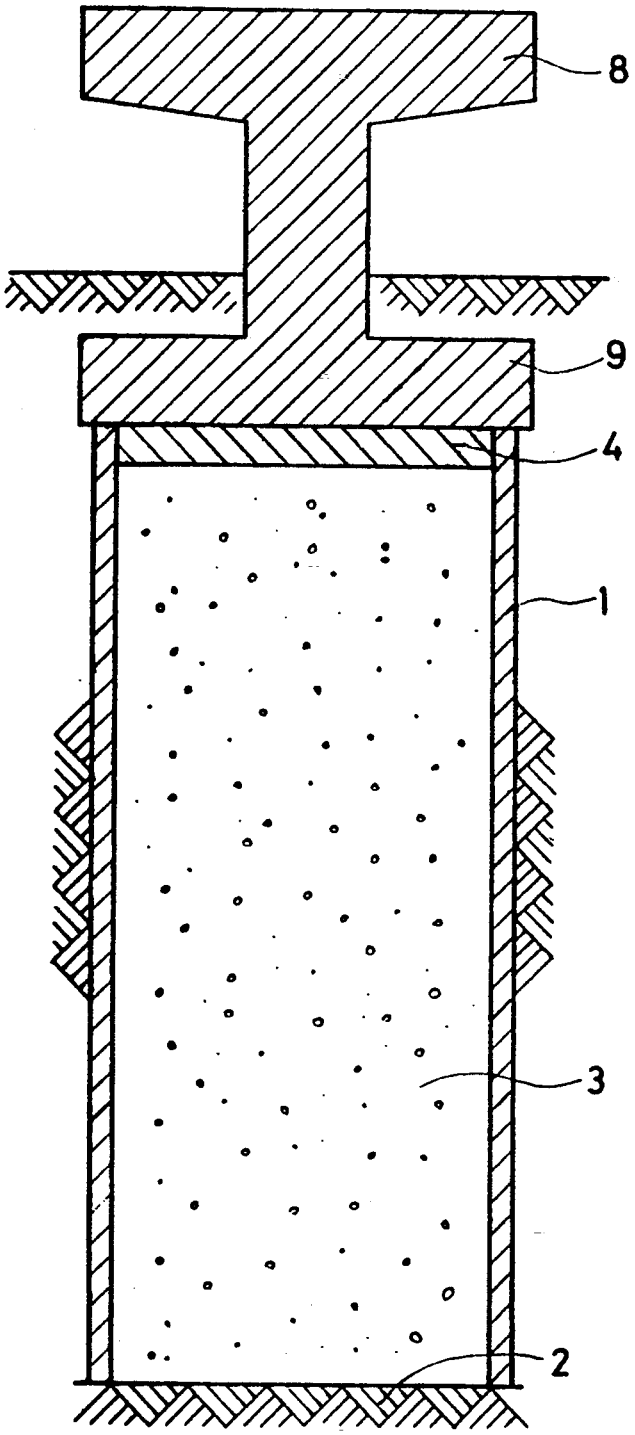
FIG. 1 is a longitudinal sectional view of a foundation having a cylindrical shell according to the present invention.
Figure 2:
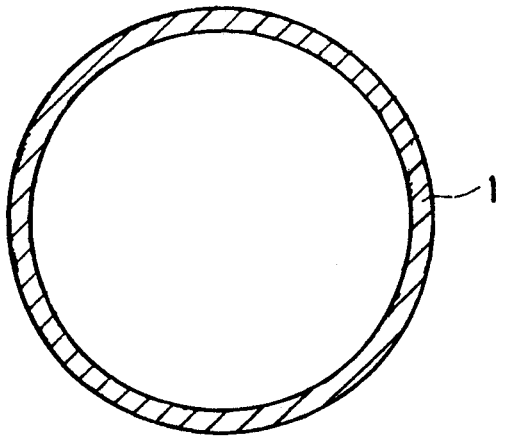
FIG. 2 is a transverse sectional view of a cylindrical shell in the foundation having the cylindrical shell according to the present invention.

FIG. 1 shows an embodiment of a cylindrical shell foundation according to the present invention. In the drawing, reference numeral 1 denotes a cylindrical shell of a foundation according to the invention. The cylindrical shell is formed into a cylindrical shape as a whole by the in situ placing of concrete, and its cross-section is circular as shown in FIG. 2 in this embodiment. However, the shell 1 may have a square or rectangular cross-section or a polygonal cross-section such as a hexagonal or octagonal cross-section, whenever necessary. When the shell has a circular cross-section, its diameter may be greater than that of a conventional well foundation in many cases and is sometimes as great as 30 m. The lower end of the cylindrical shell 1 reaches a support ground 2 and transmits the foundation load applied to the cylindrical shell 1 to the support ground 2. Reference numeral 3 in FIGS. 1 and 3 denotes an internal solidified soil encompassed by the cylindrical shell 1. When a ring-like groove is excavated in the present invention at the position of the foundation in order to build up the cylindrical shell 1, its internal soil is neither excavated nor discharged but is left as such.

According to one embodiment of the present invention, after the cylindrical shell 1 is built up by excavating a ring-like groove and by placing the concrete in situ into the groove, a chemical hardener such as a cement milk and other chemical hardeners are mixed, stirred with the remaining internal soil and solidified by a conventional method to form the internal solidified soil 3 described above. The solidified soil 3 can also be formed by pouring the chemical hardener solution into the soil by a known pouring method.

In such a case, the internal solidified soil 3 is provided with a depth reaching the support ground 2 in the same way as the lower end of the cylindrical shell 1, and the blend proportion of the chemical hardener to the soil is determined by carrying out a strength test of a sample of the solidified soil using the soil in situ so that the internal solidified soil 3 can have a stable and sufficient bearing capacity.

Since the internal solidified soil 3 per se has a sufficient bearing capacity, the load of the internal solidified soil 3 per se is transmitted directly by it to the support ground 2 and thus does not generate an increase of the load to be borne by the cylindrical shell 1 due to a negative friction phenomenon. Since the internal solidified soil 3 is sufficiently solidified, the change over time such as consolidation settlement does not occur. Furthermore, since a cavity formed due to consolidation settlement is not formed inside the upper part of the cylindrical shell 1, breakage of the concrete resulting from freezing of flowing water remaining inside the foundation and corrosion of the reinforcing bars buried in the cylindrical shell 1 do not occur, either.

In addition to the load supporting function of the concrete cylindrical shell 1, the internal solidified soil 3 also has the function of a foundation structure which transmits the load of the superstructure 8 to the support ground 2. In the present invention, the periphery of the internal solidified soil 3 is much more covered and protected by the concrete cylindrical shell 1 than a conventional foundation structure which is built up by merely mixing and stirring the chemical hardener with the soil. Therefore, the present invention can improve the reliability of the strength and reduce the possibility of the degradation of the internal solidified soil 3 due to the external surrounding environment.

Figure 3:
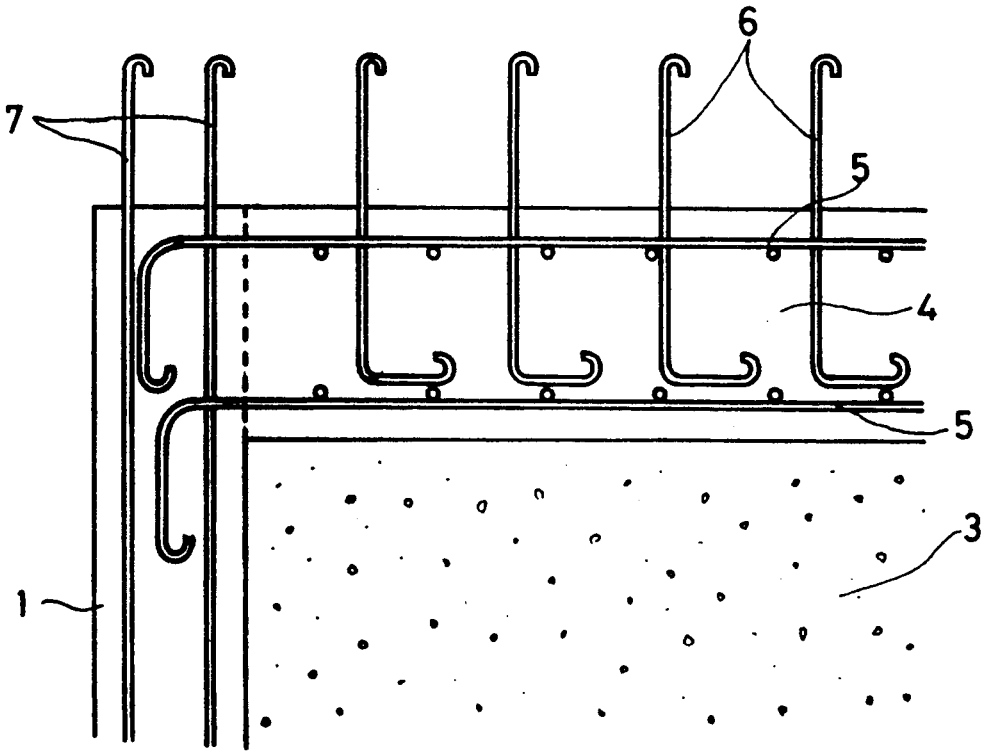
FIG. 3 is an enlarged longitudinal sectional view showing the upper part of the foundation in the present invention.

Reference numeral 4 in FIGS. 1 and 3 denotes a covering slab, which is positioned on the upper surface of the internal solidified soil 3 inside the cylindrical shell 1. The covering slab 4 is produced by a process comprising arranging horizontal reinforcing bars 5 and placing the concrete in situ as shown in detail in FIG. 3. Generally, the peripheral edge of the covering slab 4 is set to be fixed or connected to the upper part of the cylindrical shell 1, and the end portions of the horizontal reinforcing bars 5 are bent and inserted into the concrete of the cylindrical shell 1 so as to establish a mechanical interconnection. In this way, the internal solidified soil 3 inside the cylindrical shell 1 is isolated from the external soil, etc., and invasion of flowing water into the internal solidified soil 3 is also prevented. Since the internal solidified soil 3 has a bearing capacity by itself, no problem occurs even when the placing of the concrete covering slab 4 is carried out directly on the upper surface of the internal solidified soil 3 without using any particular temporary work members. Additionally, it is not always required to use reinforcing bars in the covering slab 4 and it depends on the state of the cover slab's use.

In order to permit the cylindrical shell 1 and the internal solidified soil 3 to bear the load of the superstructure 8 such as the bridge pier of a bridge, using the covering slab 4 which covers the upper surface of the internal solidified soil 3 having the bearing capacity, a method wherein a plurality of connecting reinforcing bars 6 are set to be extended upward from the upper surface of the covering slab 4 and a plurality of connecting reinforcing bars 7 are set to be extended upward from the upper end of the cylindrical shell 1, followed by placing concrete in situ to the cylindrical shell 1 and covering slab 4, to bury the protruding connecting reinforcing bars 6 and 7 in the concrete of a footing 9 of the superstructure 8, is most preferable. Incidentally, either of the connecting reinforcing bars 6 or 7 may be omitted.

In the embodiment described above, the lower part of the cylindrical shell 1 has the same thickness as the upper part thereof. However, the lower part of the cylindrical shell 1 may have a flared or spread-out bottom so as to have a different thickness and a different shape from the upper part in order to increase the allowable bearing capacity at the bottom of the cylindrical shell 1.

Figure 4:
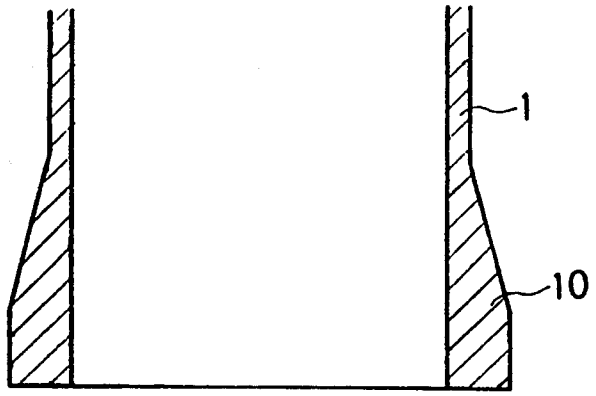
FIGS. 4, 5 and 6 are longitudinal sectional views showing three embodiments at the lower part of the cylindrical/shell of the foundation according to the present invention.

FIG. 4 shows an example of the cylindrical shell 1 having an outer flared bottom portion 10 which is formed by placing concrete in situ on the outer side surface of the shell 1 at its lower part.

Figure 5:
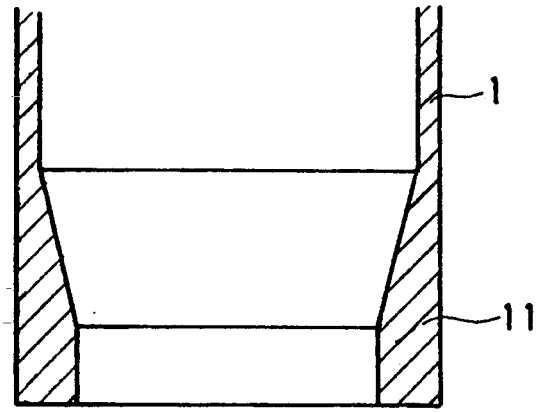

FIG. 5 shows an example of the cylindrical shell 1 having an inner flared bottom portion 11 which is formed by placing concrete in situ on the inner side surface of the shell 1 at its lower part.

Figure 6:
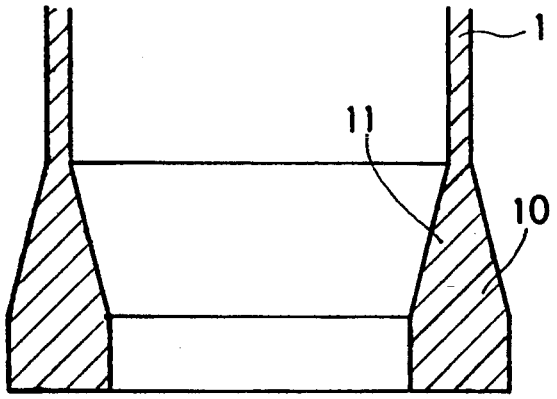

FIG. 6 shows an example of the cylindrical shell 1 having the outer flared bottom portion 10 and the inner flared bottom portion 11 which are formed by placing concrete in situ on both outer and inner side surfaces of the shell 1 at its lower part.

Next, an embodiment of a method of making the cylindrical shell-foundation will be explained.

To build up the cylindrical shell-foundation described above, a guide wall having a shape which corresponds to the cross-sectional shape of the circular or rectangular cylindrical shell 1 is formed in advance on the ground surface of the position at which the foundation is to be built up. A groove excavation work is carried out to obtain a ring-like groove with a predetermined depth along the guide wall by the use of an excavator so as to excavate a ring-like groove. When the flared bottom portions 10, 11, etc. are disposed on the inner and/or outer periphery of the cylindrical shell 1, an excavator for the flared bottom is inserted into the groove, and predetermined flared bottom grooves are excavated at the groove bottom portion. A bentonite solution is poured into the groove during excavation so as to protect the groove wall in the same way as in the conventional groove excavation work. After the excavation work described above is completed, reinforcing bars are arranged suitably and the concrete is then poured or placed into the excavated groove. In this way, the cylindrical shell 1 is completed.

In some cases, the excavation of the ring-like groove is carried out by dividing the entire periphery of the groove into a plurality of segments, effecting the partial excavation, placing the concrete in situ into the partial groove portion, and repeating the partial excavation and partial concrete placing to complete the cylindrical shell 1 as to the entire periphery thereof, without excavating the entire periphery from the beginning.

After the cylindrical shell 1 is completed, the chemical hardener such as a cement milk is mixed and stirred with the soil and sand inside the cylindrical shell 1 by a stirrer/mixer so as to solidify the soil and sand, and in this way, the internal solidified soil 3 is obtained. After the solidification of the internal solidified soil 3 is completed, the reinforcing bars necessary for the covering slab 4 and the reinforcing bars 6 for interconnection with the upper structure 8 are arranged on the upper surface of the internal solidified soil 3 and then concrete is placed to complete the covering slab 4.

Figure 7:
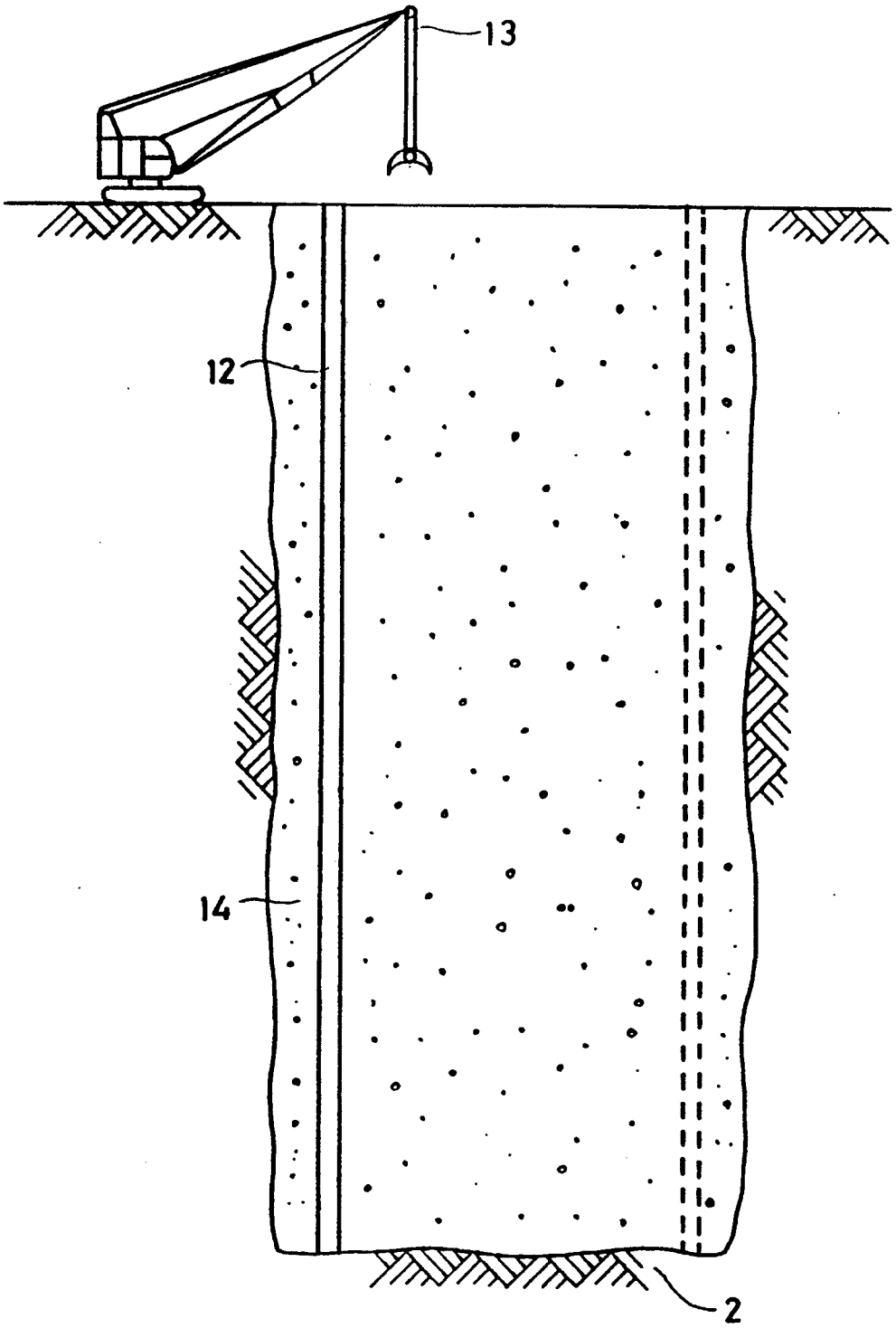
FIG. 7 is a longitudinal sectional view for explaining the construction method of the foundation having the cylindrical shell according to the present invention.

The cylindrical shell-foundation according to the present invention can be completed by the construction method described above. However, the present invention can also employ the construction method shown in FIG. 7 which forms the solidified soil 14 by mixing and stirring in advance the chemical hardener with the underground soil of the site of the foundation before the excavation of the ring-like groove 12 for the cylindrical shell 1 is carried out by the excavator. Such a method can allow the work to be carried out more efficiently and more safely.

When the construction method described above is employed, mixing and stirring of the chemical hardener is made in a wider range of the soil than that of the cylindrical shell by a stirrer/mixer, and the solidified soil 14 is formed in the direction of the depth of such a range. That is, the soil outside the cylindrical shell is also solidified with the chemical hardener at the same time as the solidification of the soil inside the cylindrical shell, according to the construction method described above.

Next, the ring-like groove 12 for the cylindrical shell 1 is excavated using an excavator 13. The position at which the cylindrical shell 1 is to be situated falls within the range of the solidified soil 14. Therefore, the excavation is carried out in the ring-like form inside the solidified soil 14 so that the groove wall is formed in contact with the solidified soil 14. When the excavation is carried out in this way, the groove wall of the ring-like groove to be excavated has already been solidified and reinforced sufficiently and for this reason, no particular means for protecting the groove wall, as has been necessary in the conventional groove excavation, is necessary when the groove is excavated. Accordingly, the work can be carried out efficiently while omitting the step of groove wall protection. Moreover, since both the inside and the outside of the groove wall are solidified, the mechanical strength is higher than the conventional groove wall protection means and the unexpected collapse of the groove wall, inclusive of the case of the excavation of the flared bottom, can be prevented and the work can be carried out in a safe manner.

In some cases, the excavation of the ring-like groove is carried out, not only by a single excavation of the full periphery, but by several separate excavations comprising dividing the entire periphery in the peripheral direction, excavating a partial groove thus divided, placing the concrete into the partial groove in situ for which the partial excavation is completed, and repeating the same partial excavation and concrete placing to complete the formation of the cylindrical shell 1 along the entire periphery.

After the excavation of the ring-like groove 12 is completed, the reinforcing bars are arranged and the concrete is placed into the groove and, in this way, the cylindrical shell 1 is completed. Since the soil inside the cylindrical shell 1 is solidified by the chemical hardener and the internal solidified soil 3 is formed, the covering slab 4 is completed by arranging the necessary reinforcing bars for the covering slab 4 and the reinforcing bars 6 for interconnection with the superstructure 8, on the upper surface of the internal solidified soil 3 and placing or pouring the concrete.

The foundation having the cylindrical shell according to the present invention is suitable for supporting structures, towers, tanks, silos, piers of bridges, etc., and its outer scale and structural design are determined in accordance with the structures to be supported, the ground, the working efficiency of the machine employed for the execution, and other conditions. When the shell is cylindrical, for example, a most preferred scale is such that the outer diameter is 3 to 30 m, depth is 4 to 100 m and wall thickness is 0.5 to 3 m.

As described above, the foundation having the cylindrical shell according to the present invention comprises the cylindrical shell made of a cast-in-place concrete which is placed into the ring-like groove excavated while leaving the columnar soil thereinside as such in the soil at the place of installation of the foundation, and the internal solidified soil formed by solidifying the columnar soil surrounded by the cylindrical shell, by the use of the chemical hardener. Accordingly, the internal solidified soil does not undergo consolidation settlement for a long time and the load of the internal solidified soil itself is directly transmitted to the support ground of the internal bottom surface of the cylindrical shell. For this reason, the increase of the load bearing due to the negative friction does not occur in the cylindrical shell. Since the consolidation settlement does not occur in the internal solidified soil, no cavity develops at the inner, upper part of the cylindrical shell, and the destruction of the concrete due to freezing of flowing water inside the foundation and the corrosion of the reinforcing bars buried in the cylindrical shell do not occur.

Furthermore, the internal solidified soil has by itself the function of the foundation structure which transmits the load of the superstructure to the support ground in addition to the concrete cylindrical shell. In such a case, the periphery of the internal solidified soil is covered with, and protected by the concrete cylindrical shell. Therefore, the foundation of the present invention is superior to the foundation structure formed by merely mixing and stirring the chemical hardener with the soil as has been done in the prior art, in reliability of the strength and assurance against the degradation of the internal solidified soil due to the surrounding external environment. When the superstructure is placed on the upper surface of the internal solidified soil, the covering slab made of concrete, which is placed in situ for supporting the superstructure, is preferably disposed on the internal solidified soil. When the concrete for the covering slab is poured, the internal solidified soil provides sufficient bearing capacity. Therefore, the covering slab can be directly set on the surface of the internal solidified soil without requiring any specific temporary work members.

The construction method of the foundation having the cylindrical shell according to the present invention comprises excavating the ring-like groove in the soil at the place of installation of the foundation while leaving the columnar soil located radially inward of the groove, placing the concrete into the ring-like groove to form the cylindrical shell portion, and mixing and stirring the chemical hardener with the columnar soil surrounded by the cylindrical shell portion to form the internal solidified soil. Therefore, the foundation having a novel cylindrical shell can be constructed.

Furthermore, in the construction method of the foundation having the cylindrical shell, it is also possible to employ a construction method in which the chemical hardener is mixed and stirred in advance with the soil of the ground in a wider region than a portion at which the cylindrical shell is to be disposed, and then excavating the ring-like groove while leaving the internal solidified soil, followed by placing the concrete into the ring-like groove so as to form the cylindrical shell. If this method is employed, the collapse and fall of the groove wall do not occur during the excavation of the ring-like groove and means employed particularly for protecting the groove wall can be omitted. Therefore, the excavation of the ring-like groove can be carried out efficiently, and the execution can be carried out safely even when the ring-like groove is excavated for a cylindrical shell having a flared bottom.

While the invention has been described in detail and with reference to specific embodiments thereof, it will be apparent to one skilled in the art that various changes and modifications can be made therein without departing from the spirit and scope thereof.

What is claimed is:

1. A foundation for supporting a superstructure thereon, comprising:

a cylindrical shell made of a cast-in-place concrete placed into a ring-like groove which is formed by excavation of the soil at a place of installation of the foundation, leaving a columnar soil radially inwardly of said ring-like groove without discharging the columnar soil;

an internal solidified soil formed by solidifying said columnar soil surrounded by said cylindrical shell with a chemical hardener; and a covering slab, made of a concrete placed in situ, disposed on an upper surface of said internal solidified soil, said covering slab being fixed to an upper part of said cylindrical shell such that said internal solidified soil is isolated from external soil, and invasion of flowing water into said internal solidified soil is thereby prevented.

2. The foundation according to claim 1, wherein a cross-sectional shape of said cylindrical shell is circular.

3. The foundation according to claim 1, wherein a cross-sectional shape of said cylindrical shell is polygonal.

4. The foundation according to claim 1, wherein said chemical hardener is a cement milk.

5. The foundation according to claim 1, wherein said cylindrical shell has an outer flared bottom portion on a lower outer side surface of said cylindrical shell.

6. The foundation according to claim 1, wherein said cylindrical shell has an inner flared bottom portion on a lower inner side surface of said cylindrical shell.

7. The foundation according to claim 1, wherein said cylindrical shell has outer and inner flared bottoms on a lower outer side surface and a lower inner side surface of said cylindrical shell.

8. The foundation according to claim 1, wherein said covering slab includes reinforcing bars therein.

9. The foundation according to claim 8, wherein a peripheral edge of said covering slab is set to be connected to the upper part of said cylindrical shell.

10. The foundation according to claim 9, wherein reinforcing bars for interconnection with the superstructure are disposed on at least one of an upper end of said cylindrical shell and an upper surface of said covering slab.

11. The foundation according to claim 1, further comprising an outer solidified soil solidified by the use of said chemical hardener at a location outside of said cylindrical shell.

12. A method of constructing a foundation having a cylindrical shell, comprising the steps of:

excavating a ring-like groove in the soil at a place of installation of the foundation in such a manner as to leave a columnar soil radially inwardly with respect to said ring-like groove;

placing concrete into said ring-like groove to form a cylindrical shell;

mixing and stirring a chemical hardener with said columnar soil surrounded by said cylindrical shell so as to form an internal solidified soil;

placing concrete in situ on an upper surface of said internal solidified soil to form a covering slab; and fixing said covering slab to an upper part of said cylindrical shell such that said internal solidified soil is isolated from external soil, and invasion of flowing water into said internal solidified soil is thereby prevented.

13. The method of constructing a foundation having a cylindrical shell according to claim 12, wherein the excavation of said ring-like groove comprises partially excavating so as to excavate divided sections formed by dividing an entire periphery of said ring-like groove in a peripheral direction, partially placing concrete for each section of said groove which has been partially excavated, and forming said cylindrical shell by repeating said partial excavation and said partial concrete placing.

14. A method of constructing a foundation having a cylindrical shell, comprising:

mixing and stirring a chemical hardener with a soil of the ground in a wider range of the soil than a location at which a cylindrical outer shell portion is to be disposed, so as to carry out solidification treatment of the soil inside and outside of said location of said cylindrical outer shell portion;

excavating a ring-like groove at said location while leaving said solidified soil radially inwardly with respect to said location of said cylindrical outer shell portion;

placing concrete into said ring-like groove so as to form said cylindrical shell;

placing concrete in situ on said solidified soil to form a covering slab; and fixing said covering slab to an upper part of said cylindrical shell such that said solidified soil located within said cylindrical shell is isolated from external soil, and invasion of flowing water into said solidified soil located within said cylindrical shell is thereby prevented.

15. The method of constructing a foundation having a cylindrical shell according to claim 14, wherein the excavation of said ring-like groove comprises partially excavating so as to excavate divided sections formed by dividing an entire periphery of said ring-like groove in a peripheral direction, partially placing concrete for each section of said groove which has been partially excavated, and forming said cylindrical outer shell portion by repeating said partial excavation and said partial concrete placing.

* * * * *